United States Patent [19]

Reichel

[11] Patent Number: 4,653,933

[45] Date of Patent: Mar. 31, 1987

[54] RESIN WATCH CASE WITH HIDDEN LUG SUPPORT

[75] Inventor: Judith Reichel, Southbury, Conn.

[73] Assignee: Timex Corporation, Waterbury, Conn.

[21] Appl. No.: 905,997

[22] Filed: Sep. 11, 1986

[51] Int. Cl.[4] ..... G04B 37/00

[52] U.S. Cl. ..... 368/282; 224/164

[58] Field of Search ..... 368/280–282; 224/164, 167, 168, 173, 180

[56] References Cited

U.S. PATENT DOCUMENTS

| | | | |
|---|---|---|---|
| 4,298,973 | 11/1981 | Saito | 368/281 |
| 4,389,006 | 6/1983 | Nagata | 224/164 |
| 4,432,476 | 2/1984 | Yokosuka | 224/164 |
| 4,432,654 | 2/1984 | Hesselschwerdt | 368/282 |
| 4,462,497 | 7/1984 | Thompson | 368/282 |

FOREIGN PATENT DOCUMENTS

| | | | |
|---|---|---|---|
| 2102992 | 2/1983 | United Kingdom | 368/280 |

*Primary Examiner*—Bernard Roskoski

*Attorney, Agent, or Firm*—William C. Crutcher

[57] ABSTRACT

A resin watch case with a substantially round bezel is provided with relatively thin lugs or "horns" for conventional attachment of a strap or band with retractable spring bars having pins passing through holes in the lugs. The lugs are angled downward from the bezel to terminate below it. An integral reinforcing cross member extending between the lugs and which is concealed by the strap and bezel serves to reinforce the thin lugs against breakage. The overall attachment gives the appearance of a thin lug in a resin case which is normally only possible with the strength of a metal case.

5 Claims, 6 Drawing Figures

RESIN WATCH CASE WITH HIDDEN LUG SUPPORT

BACKGROUND OF THE INVENTION

This invention relates to attachment of a strap or band to a watch case, and more particularly to an improved arrangement of lugs suitable for a resin or plastic watch case which gives the appearance of thin lugs and yet provides the required strength.

Watch case attachments are well known in metal cases in which a pair of opposed lugs or horns on either side of the watch case are provided with holes for receiving a retractable spring bar passing through a hole in the end of the strap or band. This is the normal type of attachment for a strap to a watch case which has been used for many years with metal watch cases. More recently, watch cases of resin or plastic material have been used in wristwatches. These materials do not have the strength of metal cases, and consequently conventional lugs exhibit breakage unless they are made very thick, which leads to an unsightly appearance. Particularly, in the case of a round quartz analog watch with a maximum viewing area, where the bezel around the lens is to appear as thin as possible, the lugs for attaching the strap should also have a thin appearance when viewed from the top of the watch.

One type of construction which has been used in a plastic watch case is the employment of multiple interleaved hinged elements which provide additional strength needed in a plastic case attachment. One example of such a construction is seen in U.S. Pat. No. 4,561,077 issued Dec. 24, 1985, which in its preferred form employs four lugs rather than two on either side of the watch case. A cover portion between lugs which is integral with the bezel serves partially to conceal the interleaved strap hinge elements.

Attachments have also been proposed in which a cross-member between lugs and metal cases provides a concealing ledge, as shown in U.S. Pat. No. 4,432,654 issued Feb. 21, 1984, or as shown in U.K. Patent Application GB 2087710A published June 3, 1982.

An improved thin lug construction for a resin case with the required strength would give more freedom to a watch designer to proportion the lugs with respect to the rest of the watch case from an esthetic standpoint rather than from the dictates of necessary physical strength.

Accordingly, one object of the present invention is to provide an improved resin watch case and lug construction for attachment to a conventional watchband.

Another object of the invention is to provide an improved resin watch case with the appearance of thin lugs with the necessary strength.

DRAWING

The invention both as to organization and method of practice, together with further objects and advantages thereof, may best be understood by reference to the following description taken in connection with the accompanying drawing in which:

FIG. 1 is a top plan view of a watch case according to a preferred embodiment of the present invention with a portion of the strap shown attached to one set of lugs, FIG. 2 is a side elevation view of FIG. 1, partly in section, taken along lines II—II of FIG. 1

FIG. 3 is an enlarged view of the cross section area shown in FIG. 2, with a portion of the watch strap added, FIG. 4 is a top plan view of another watch case according to the present invention, FIG. 5 is a side elevation view of FIG. 4, partly in section, taken along lines V—V of FIG. 4 and FIG. 6 is an enlarged view of the cross sectional portion of FIG. 5 showing a portion of the strap attached.

SUMMARY OF THE INVENTION

Briefly stated, the invention comprises the improvement in a watch case of plastic material with a substantially round bezel, and with pairs of opposed lugs which are relatively thin when viewed from the top. The lugs are slanted downward from the bezel to provide terminating ends below the bezel and adapted for attachment to a conventional strap using retractable spring bars. In accordance with the present invention, a reinforcing cross-member between lugs serves to provide a reinforcing strap between lugs which is spaced from the underside of the bezel extension and arranged to be concealed by the strap when it is attached between the lugs. The cross-member may be integral with the bezel proper or it may be separated from it.

DESCRIPTION OF THE PREFERRED EMBODIMENT

Figure 1:
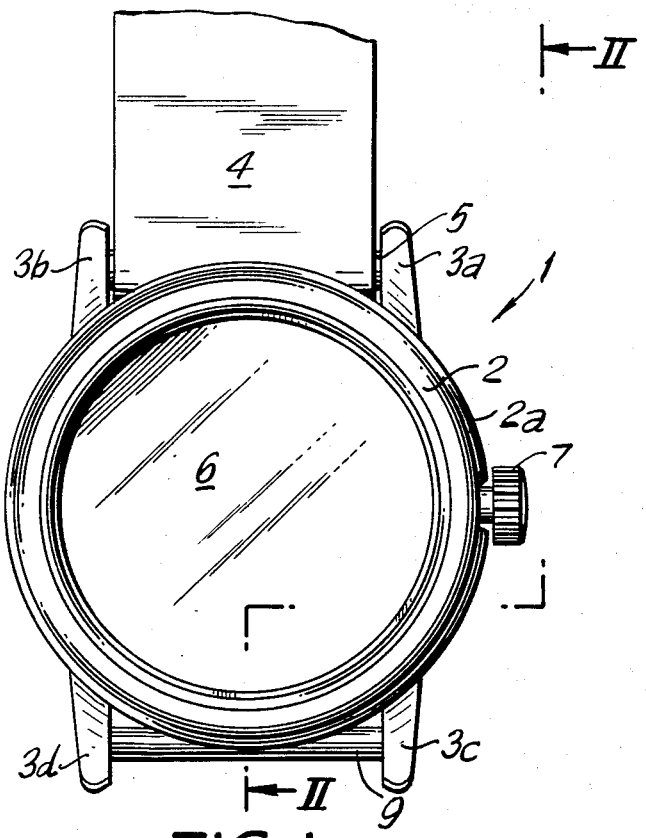

Referring now to FIG. 1 of the drawing, a watch case is shown generally at 1 which includes a substantially round bezel, 2 and spaced pairs of parallel opposed horns or lugs 3*a*, 3*b* on one side and 3*c*, 3*d* on the other side. A portion is shown of a conventional watch strap 4 attached between lugs 3*a*, 3*b* by means of a conventional retractable spring bar 5. Other elements of the watch are not material to the present invention, include a lens 6 covering the timekeeping display and a crown 7.

The material for the watch case is of resin or a plastic material. One suitable material is acrylonitrile-butadiene-styrene (ABS). This material is manufactured by various suppliers and may be known as Novodur TK or Monsanto No. 640, or as Cycolac "T". Novodur, Monsanto and Cycolac are U.S. Registered Trademarks.

Figure 2:
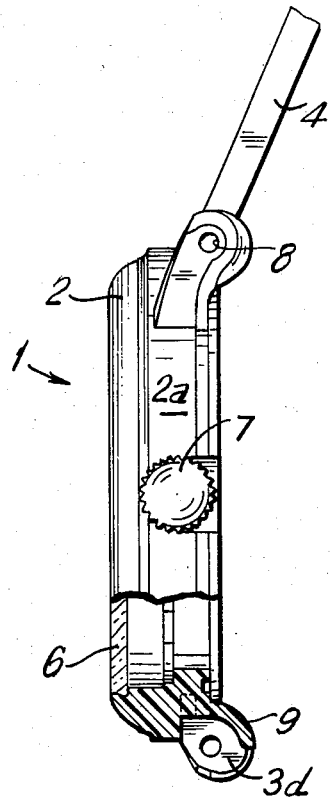

Referring to FIG. 2 of the drawing, bezel 2 defines a substantially cylindrical outer surface 2*a*. The lugs, as shown in the case of lug 3*a* of FIG. 2 extend from the cylindrical surface 2*a* and slope downwardly to their terminations which are provided with spring bar holes 8. The downward slope and curvature of the lugs is very important to the invention so as to locate holes 8 at or below the bottom of the cylindrical bezel surface 2*a* for reasons to be explained.

Figure 3:
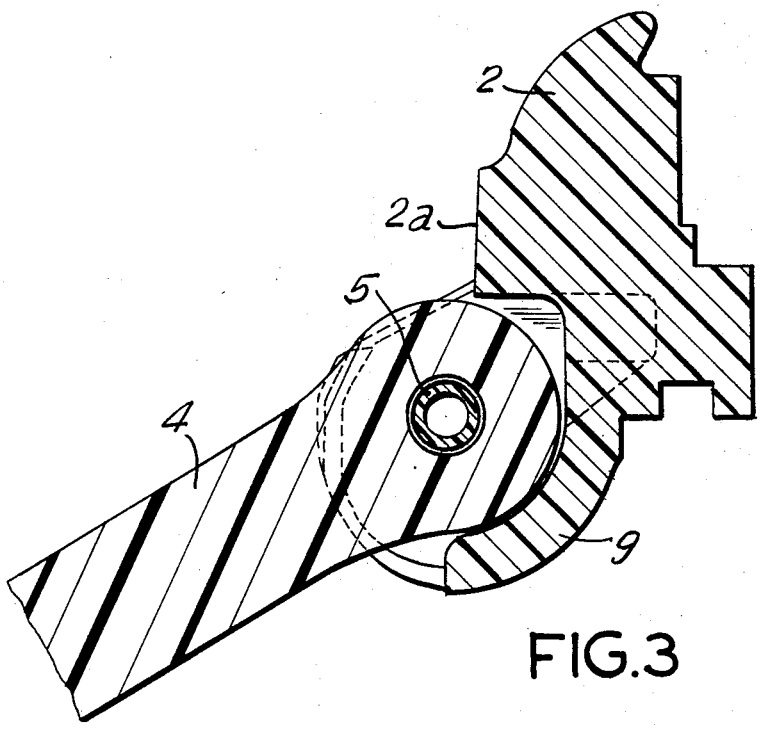

In accordance with the present invention, and as seen in the cross sectional view of FIG. 2 and the enlarged view thereof in FIG. 3, a reinforcing cross-member 9 extends a similar cross-member (not shown) extends between 3*c*, 3*d* and between lugs 3*a*, 3*b*. This reinforcing member 9 has an inner surface contoured to match with the loop of the strap, and has an outer contoured surface following the outline of the lug.

Referring now to FIG. 3 of the drawing, the reinforcing cross-member 9 is seen to be integral with the bezel 3. A portion of strap 4 is shown to be attached between lugs by means of the conventional spring bar seen in cross section at 5. As will be evident, the extended cylindrical surface 2*a* of bezel 2 extends over the attachment end of strap 4 to partially conceal it. Strap 4, in turn, conceals the reinforcing cross-member 9 from view.

Figure 4:
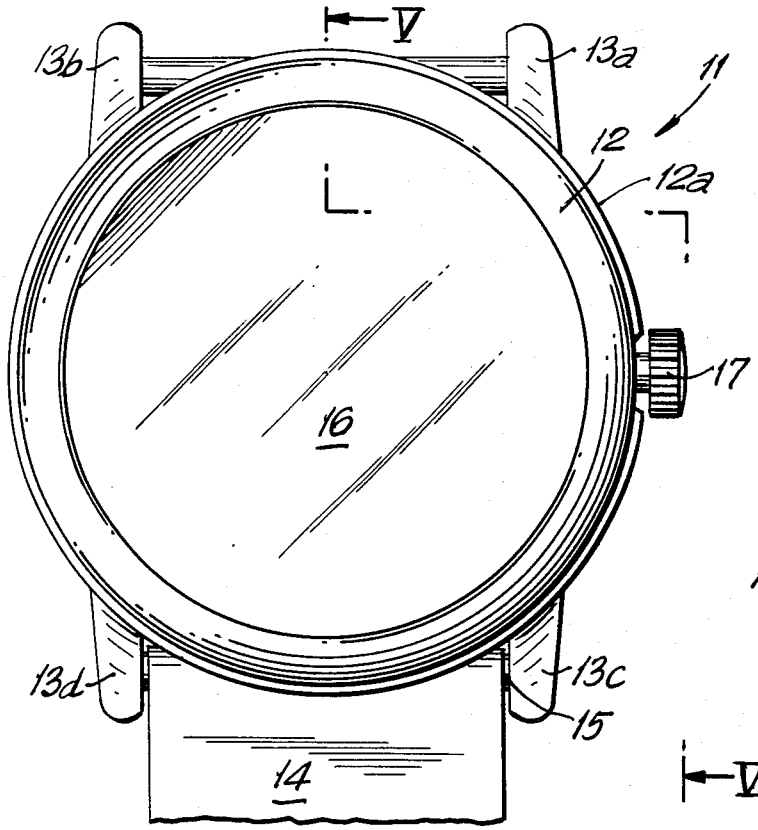
Figure 5:
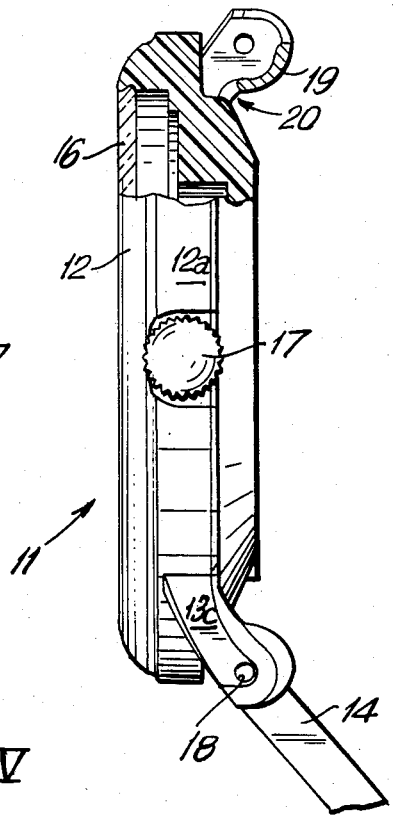
Figure 6:
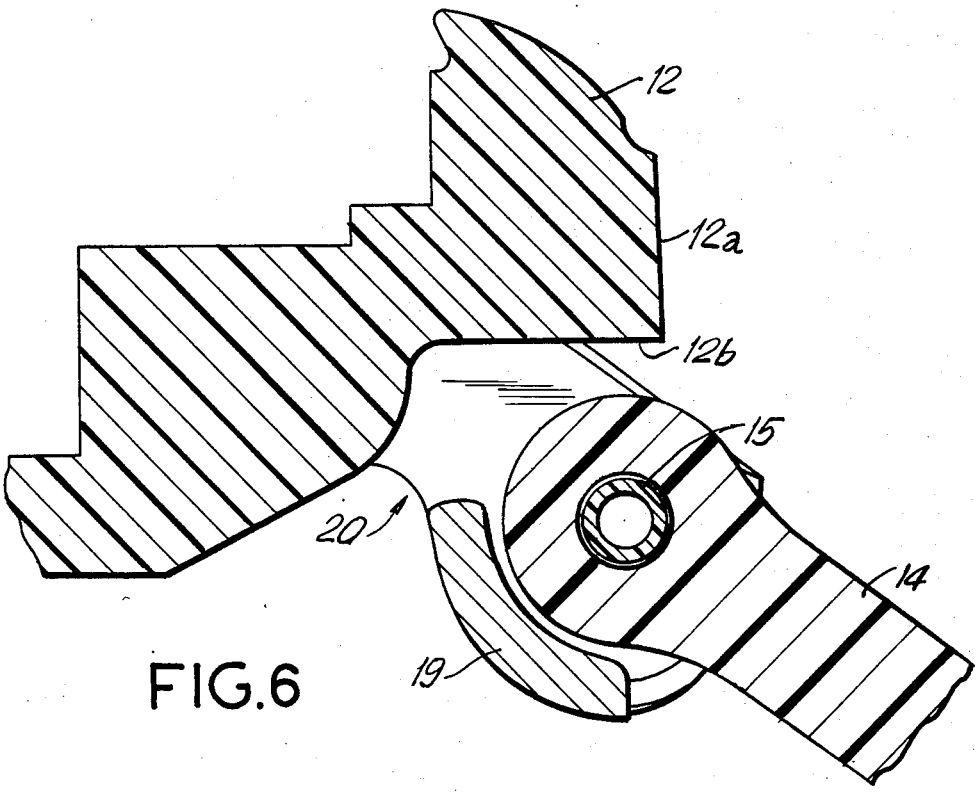

FIGS. 4–6 show another embodiment of the invention. A watch case 11 includes a round bezel 12 and lugs 13*a* through 13*d* as before, with a portion of a watch strap 14 attached by spring bar 15. The lens is shown at 16 and the crown at 17. Referring to FIG. 5, the bezel 12 includes a cylindrical surface 12*a* from which the lugs, as seen by the lug 13*c* commence and curve downwardly even more pronounced than those of the previous described watch to terminate in opposed spring bar holes 18.

In accordance with the present invention, as seen in FIGS. 5 and 6, a reinforcing cross member 19 is shown extending between lugs on either side of the watch. This reinforcing member extends below and is spaced from the protruding underside portion designated 12*b* of the watch bezel. Cross member 19, in this case is not integral with the watch bezel but integral with the lugs and extends only between lug members leaving a space 20. This may be desirable in some designs to give a lighter overall appearance.

While there has been described what is considered to be the preferred embodiment of the invention and one modification thereof, it is desired to secure in the appended claims all such modifications as fall within the true spirit and scope of the invention.

I claim:

1. The improvement in a wrist watch case of resin or plastic material adapted to be connected to a strap using conventional retractable spring bars, said case having a substantially round bezel with a substantially round edge, and having pairs of opposed plastic lugs on opposite sides of the watch case, said lugs extending from said edge of being of relatively thin physical dimensions which would otherwise be of insufficient strength for attachment of a conventional strap to the watch case, the improvement wherein said lugs commence in said edge and slope downwardly from said edge, and a reinforcing cross member of plastic material integrally joining each pair of said lugs below said bezel and arranged to be substantially concealed by said strap when held by a said spring bar extending between pairs of said lugs.

2. The combination according to claim 1, wherein said reinforcing cross member is also integrally joined with said bezel.

3. The combination according to claim 1, wherein said reinforcing cross member is separated from said bezel.

4. The combination according to claim 1, wherein said bezel edge extends over and is spaced from a portion of said cross-member.

5. The combination according to claim 1, wherein said cross-member defines an inner arcuate contour corresponding to the end of said strap.

* * * * *